US009975352B2

(12) United States Patent
Manabe et al.

(10) Patent No.: US 9,975,352 B2
(45) Date of Patent: May 22, 2018

(54) IMAGE FORMING DEVICE AND IMAGE FORMING APPARATUS

(71) Applicant: FUJI XEROX CO., LTD., Tokyo (JP)

(72) Inventors: Chikara Manabe, Kanagawa (JP); Hiroyuki Ueki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 53 days.

(21) Appl. No.: 14/852,720

(22) Filed: Sep. 14, 2015

(65) Prior Publication Data

US 2016/0279989 A1 Sep. 29, 2016

(30) Foreign Application Priority Data

Mar. 23, 2015 (JP) ..... 2015-059551

(51) Int. Cl.

| | |
|---|---|
| ***B41J 3/54*** | (2006.01) |
| ***B41J 3/60*** | (2006.01) |
| ***B41J 11/00*** | (2006.01) |
| ***B41J 29/377*** | (2006.01) |

(52) U.S. Cl.

CPC ..... *B41J 11/002* (2013.01); *B41J 3/543* (2013.01); *B41J 3/60* (2013.01); *B41J 29/377* (2013.01)

(58) Field of Classification Search

CPC ..... B41J 3/543; B41J 3/60; B41J 11/002
See application file for complete search history.

(56) References Cited

U.S. PATENT DOCUMENTS

| | | | | |
|---|---|---|---|---|
| 2007/0172285 | A1 | 7/2007 | Izawa et al. | |
| 2009/0237478 | A1 | 9/2009 | Hara | |
| 2011/0064468 | A1* | 3/2011 | Kawahata | G03G 15/2053 399/122 |
| 2011/0285799 | A1* | 11/2011 | Okura | B41J 11/0005 347/102 |

(Continued)

FOREIGN PATENT DOCUMENTS

| | | |
|---|---|---|
| JP | 2003-136687 | 5/2003 |
| JP | 2007-196513 | 8/2007 |
| JP | 2009-226755 | 10/2009 |

OTHER PUBLICATIONS

Abstract and machine translation of JP 2007-196513.
Abstract and machine translation of JP 2003-136687.
Abstract and machine translation of JP 2009-226755.

*Primary Examiner* — Kristal Feggins
*Assistant Examiner* — Kendrick Liu
(74) *Attorney, Agent, or Firm* — Fildes & Outland, P.C.

(57) ABSTRACT

An image forming device includes: a transporting route on which a recording medium is transported; an image forming unit that is provided on the transporting route and forms an image by discharging liquid droplets containing macromolecular particles on a front surface of the transported recording medium; a heating unit that heats the image formed on the front surface of the recording medium to a temperature higher than a glass transition point of the macromolecular particles; and a cooling unit that, before the image heated by the heating unit comes into contact with a member on the transporting route, cools the image formed on the front surface of the recording medium to a temperature equal to or lower than the glass transition point of the macromolecular particles in a non-contact state with the image.

4 Claims, 4 Drawing Sheets

(56) References Cited

U.S. PATENT DOCUMENTS

| | | | | |
|---|---|---|---|---|
| 2012/0050433 | A1* | 3/2012 | Fujikura | B41J 3/60 347/102 |
| 2014/0204162 | A1* | 7/2014 | Keoshkerian | C09D 11/30 347/103 |
| 2015/0239699 | A1* | 8/2015 | Cornell | B65H 23/24 242/615.11 |

* cited by examiner

FIG. 4

| | | GLASS TRANSITION POINT OF MACROMOLECULAR PARTICLE: [35°C] | | GLASS TRANSITION POINT OF MACROMOLECULAR PARTICLE: [45°C] | |
|---|---|---|---|---|---|
| | | PAPER TRANSPORTING SPEED 50 [m/MIN] | PAPER TRANSPORTING SPEED 100 [m/MIN] | PAPER TRANSPORTING SPEED 50 [m/MIN] | PAPER TRANSPORTING SPEED 100 [m/MIN] |
| IMAGE FORMING DEVICE OF COMPARATIVE EMBODIMENT | TEMPERATURE OF IMAGE WHEN COMING INTO CONTACT WITH TRANSPORTING ROLLER | 40 [°C] | 50 [°C] | 40 [°C] | 50 [°C] |
| | ADHESION OF IMAGE TO ROLLER ADHERED: X NOT ADHERED: O | X | X | O | X |
| IMAGE FORMING DEVICE OF PRESENT EMBODIMENT | TEMPERATURE OF IMAGE WHEN COMING INTO CONTACT WITH TRANSPORTING ROLLER | 30 [°C] | 30 [°C] | 30 [°C] | 30 [°C] |
| | ADHESION OF IMAGE TO ROLLER ADHERED: X NOT ADHERED: O | O | O | O | O |

IMAGE FORMING DEVICE AND IMAGE FORMING APPARATUS

CROSS-REFERENCE TO RELATED APPLICATIONS

This application is based on and claims priority under 35 USC 119 from Japanese Patent Application No. 2015-059551 filed on Mar. 23, 2015.

BACKGROUND

Technical Field

The present invention relates to an image forming unit and an image forming device.

SUMMARY

An aspect of the present invention provides an image forming device includes: a transporting route on which a recording medium is transported; an image forming unit that is provided on the transporting route and forms an image by discharging liquid droplets containing macromolecular particles on a front surface of the transported recording medium; a heating unit that heats the image formed on the front surface of the recording medium to a temperature higher than a glass transition point of the macromolecular particles; and a cooling unit that, before the image heated by the heating unit comes into contact with a member on the transporting route, cools the image formed on the front surface of the recording medium to a temperature equal to or lower than the glass transition point of the macromolecular particles in a non-contact state with the image.

BRIEF DESCRIPTION OF THE DRAWINGS

Exemplary embodiment(s) of the present invention will be described in detail based on the following figures, wherein

FIG. 4 is a diagram illustrating an evaluation result when an evaluation is performed by using the image forming device related to the embodiment of the invention and an image forming device related to a comparative embodiment.

DETAILED DESCRIPTION

Figure 1:
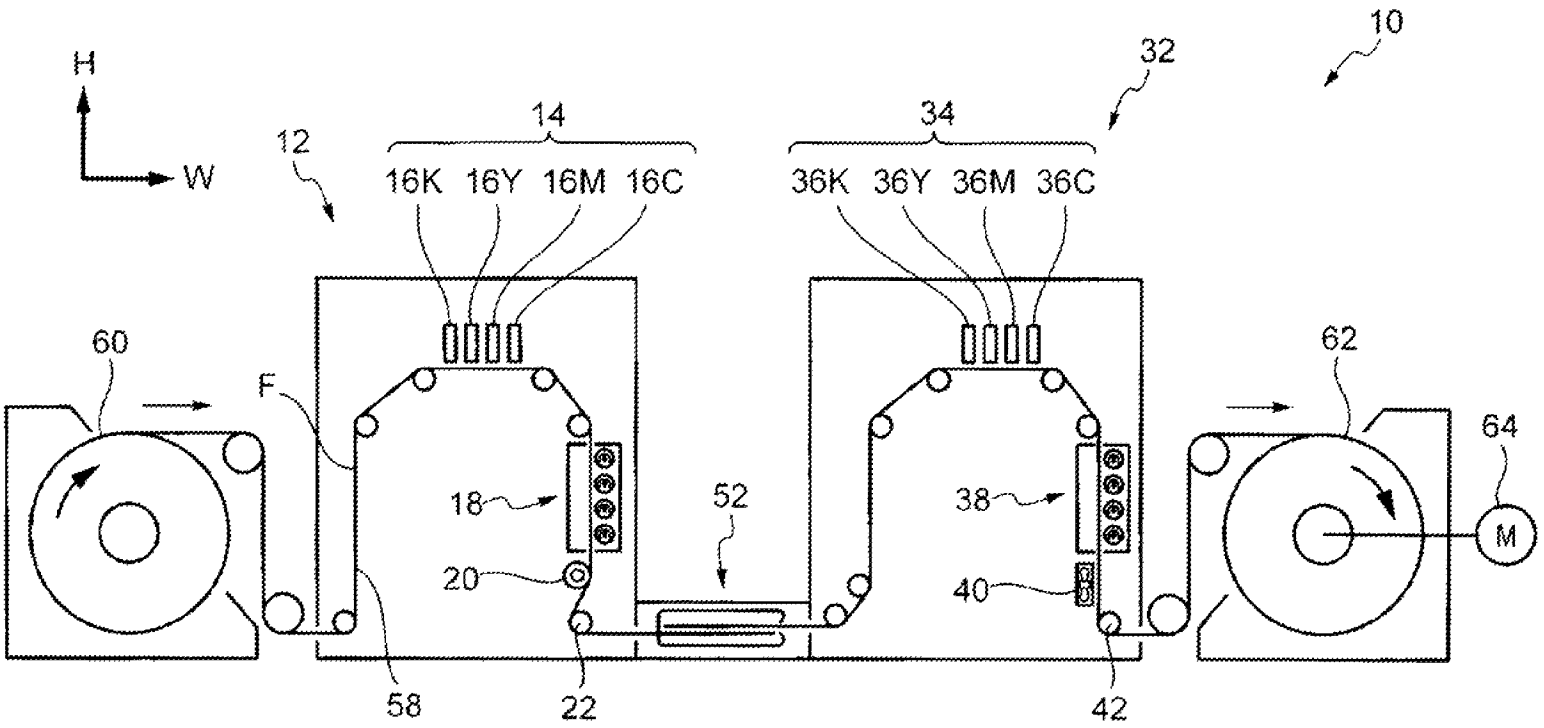
FIG. 1 is a schematic configuration diagram illustrating an image forming device related to an embodiment of the invention.

An example of the image forming device related to the embodiment of the invention will be described with reference to FIGS. 1 to 4. In addition, an arrow H in the drawings illustrates a device up-and-down direction (vertical direction), and an arrow W illustrates a device width direction (horizontal direction).

(Entire Configuration)

An image forming device 10 is an ink-jet type image forming device. The image forming device 10 includes a first image forming unit 12 that forms, as illustrated in FIG. 1, an image on the front surface of a continuous resin film F (hereinafter, "film F") as a recording medium, a second image forming unit 32 that forms an image on the rear surface of the film F, and a reversing unit 52 that reverses the rear surface of the film F. The first image forming unit 12 is an example of the image forming unit. The image forming device 10 further includes a feeding roller 60 and a winding roller 62.

(Feeding Roller and Winding Roller)

The feeding roller 60 is configured to feed the wound film F to the first image forming unit 12. In addition, the winding roller 62 is configured to wind the film F on which an image is formed. Moreover, a motor 64 that imparts a rotational force to the winding roller 62 is provided.

In this configuration, by the winding roller 62 rotating by receiving a rotational force from the motor 64, the film F wound to the feeding roller 60 is transported along a transporting route 58 of the film F and wound by the winding roller 62.

(First Image Forming Unit)

The first image forming unit 12, as illustrated in FIG. 1, is arranged along the transporting route 58 of the film F and includes an image forming unit 14 that forms an image by discharging liquid droplets on the surface of the film F.

The image forming unit 14 includes a recording head 16K that forms an image of the K color (black) by discharging liquid droplets on the film F, and a recording head 16Y that forms an image of the Y color (yellow). Moreover, the image forming unit 14 includes a recording head 16M that forms an image of the M color (magenta), and a recording head 16C that forms an image of the C color (cyan).

In addition, the recording heads 16K, 16Y, 16M, and 16C are arranged side by side so as to face the surface of the film F from the upstream side to the downstream side of the transporting direction of the film F in the order of 16K, 16Y, 16M, and 16C (hereafter "paper transporting direction"). Moreover, in the following description, in the case where K, Y, M, and C are not distinguished, there may be a case where the attached K, Y, M, and C are omitted.

Furthermore, in the first image forming unit 12, a heating unit 18 that heats the image formed on the film F and dries the image, and a cooling unit 20 that cools the image dried by the heating unit 18 are included.

In addition, the first image forming unit 12 includes, in the paper transporting direction, at the downstream side with respect to the cooling unit 20, a transporting roller 22 (an example of a member) that transports the film F along the transporting route 58 while in contact with the surface of the film F (the front surface on which the image is formed by the image forming unit 14). In this manner, the cooling unit 20 is configured to cool the image formed on the film F before the image dried by the heating unit 18 comes into contact with the member of the transporting route 58 (transporting roller 22).

In addition, the liquid droplets discharged on the film F from the recording head 16, the heating unit 18, and the cooling unit 20 will be described in detail hereinafter.

(Reversing Unit)

The reversing unit 52, as illustrated in FIG. 1, in the paper transporting direction, is arranged at the downstream side of the first image forming unit 12, and is configured to reverse the two sides surfaces of the film F transported along the transporting route 58.

(Second Image Forming Unit)

The second image forming unit 32, as illustrated in FIG. 1, in the paper transporting direction, is arranged at the downstream side of the reversing unit 52, and includes the image forming unit 34 that forms an image by discharging liquid droplets on the rear surface of the film F (the surface on which an image is not formed). The image forming unit 34 is an example of a rear surface image forming unit.

The image forming unit 34 includes a recording head 36K that forms an image of the K color (black) by discharging liquid droplets on the rear surface of the film F, and a recording head 36Y that forms an image of the Y color (yellow). Moreover, the image forming unit 34 includes a recording head 36M that forms an image of the M color (magenta), and a recording head 36C that forms an image of the C color (cyan).

In addition, the recording heads 36K, 36Y, 36M, and 36C are arranged side by side so as to face the rear surface of the film F from the upstream side to the downstream side of the paper transporting direction in the order of 36K, 36Y, 36M, and 36C.

Furthermore, in the second image forming unit 32, the heating unit 38 that heats the image formed on the film F and dries the image, and the cooling unit 40 that cools the image dried by the heating unit 38 are included. The heating unit 38 is an example of a rear surface heating unit, and the cooling unit 40 is an example of a rear surface cooling unit.

In addition, the second image forming unit 32 includes, in the paper transporting direction, at the downstream side with respect to the cooling unit 40, the transporting roller 42 that transports the film F along the transporting route 58 while in contact with the rear surface of the film F (the rear surface on which the image is formed by the image forming unit 34). In this manner, the cooling unit 40 is configured to cool the image formed on the film F before the image dried by the heating unit 38 comes into contact with the member of the transporting route 58 (transporting roller 42).

In addition, the liquid droplets discharged on the film F from the recording head 36, the heating unit 38, and the cooling unit 40 will be described in detail hereinafter.

(Main Configuration)

Next, liquid droplets discharged on the film F from the recording heads 16 and 36, the heating units 18 and 38, and the cooling units 20 and 40 will be described.

(Ink Droplet)

The liquid droplets discharged on the film F from the recording heads 16 and 36 are liquid droplets that contains macromolecular particles. In short, the ink used in the image forming device 10 is an ink that contains macromolecular particles. In addition, the ink used in the first image forming unit 12 and the ink used in the second image forming unit 32 are the same.

If an image is formed on the film F using the ink containing macromolecular particles, in contrast to the case where a water based ink is used, a film layer on which the image is configured is formed on the surface of the film F. As a result, the ink containing macromolecular particles is capable of being used in a recording medium through which moisture is hardly permeated, such as a film or coated paper.

Meanwhile, examples of the macromolecular particles include, for example, a styrene-acrylic acid copolymer, a styrene-acrylic acid-sodium acrylate copolymer, a styrene-butadiene copolymer, polystyrene, an acrylonitrile-butadiene copolymer, an acrylic ester copolymer, polyurethane, a silicon-acrylic acid copolymer, and particles such as an acrylate-modified fluororesin (latex particle). In addition, examples of the macromolecular particles further include a core-shell type macromolecular particle of which the composition is different at the center portion and the perimeter portion of the particle.

(Heating Unit)

The heating unit 18, as illustrated in FIG. 1, in the paper transporting direction, is arranged at the downstream side with respect to the image forming unit 14.

Figure 2:
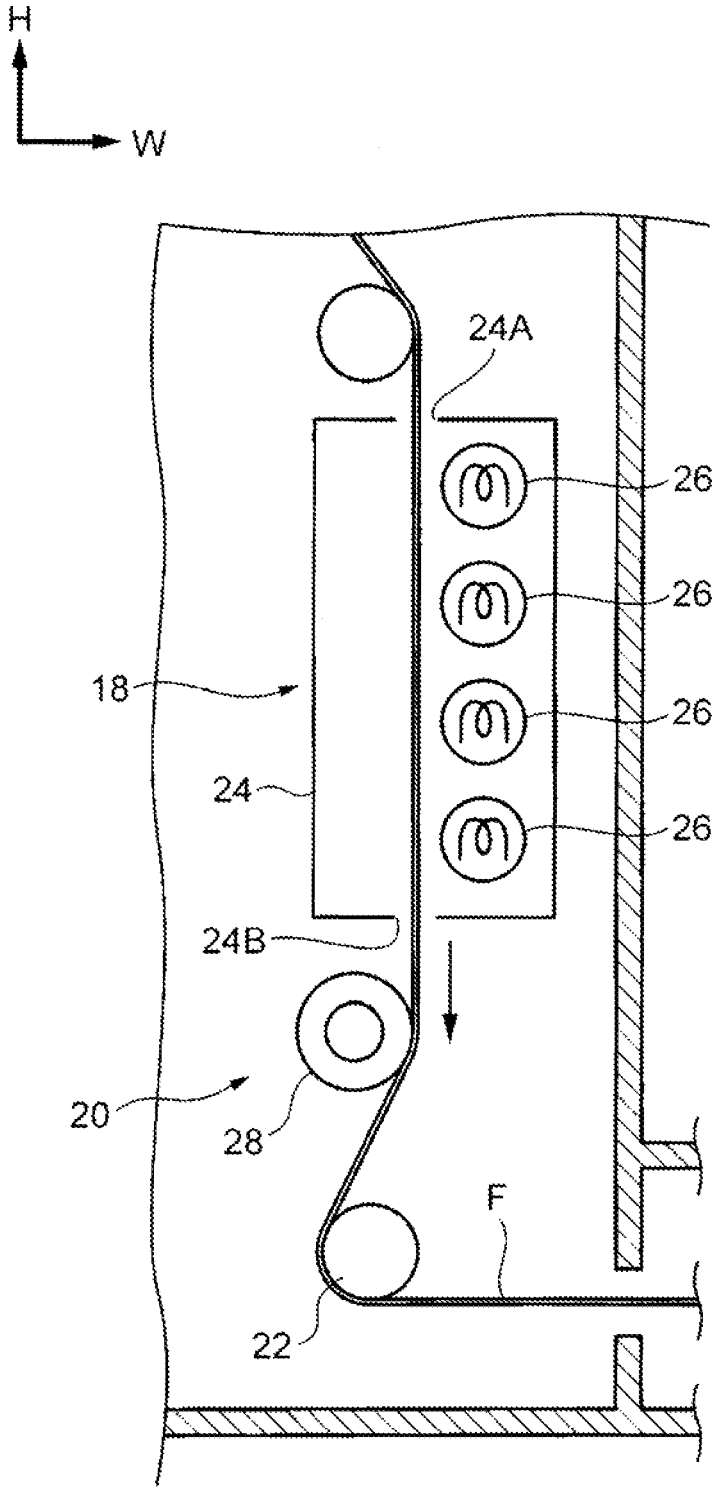
FIG. 2 is a configuration diagram illustrating a heating unit, a cooling unit, and the like included in an image forming unit related to the embodiment of the invention.

The heating unit 18, as illustrated in FIG. 2, is arranged at the portion in which the film F is transported from the upstream side to the downstream side, and includes a housing 24 in which an inlet 24A into which the film F enters and an outlet 24B through which the film F exits are formed.

Moreover, the heating unit 18 further includes plural infrared light heaters 26 arranged so as to face the surface of the transported film F.

The heating unit 38, as illustrated in FIG. 1, in the paper transporting direction, is arranged at the downstream side with respect to the image forming unit 34.

Figure 3:
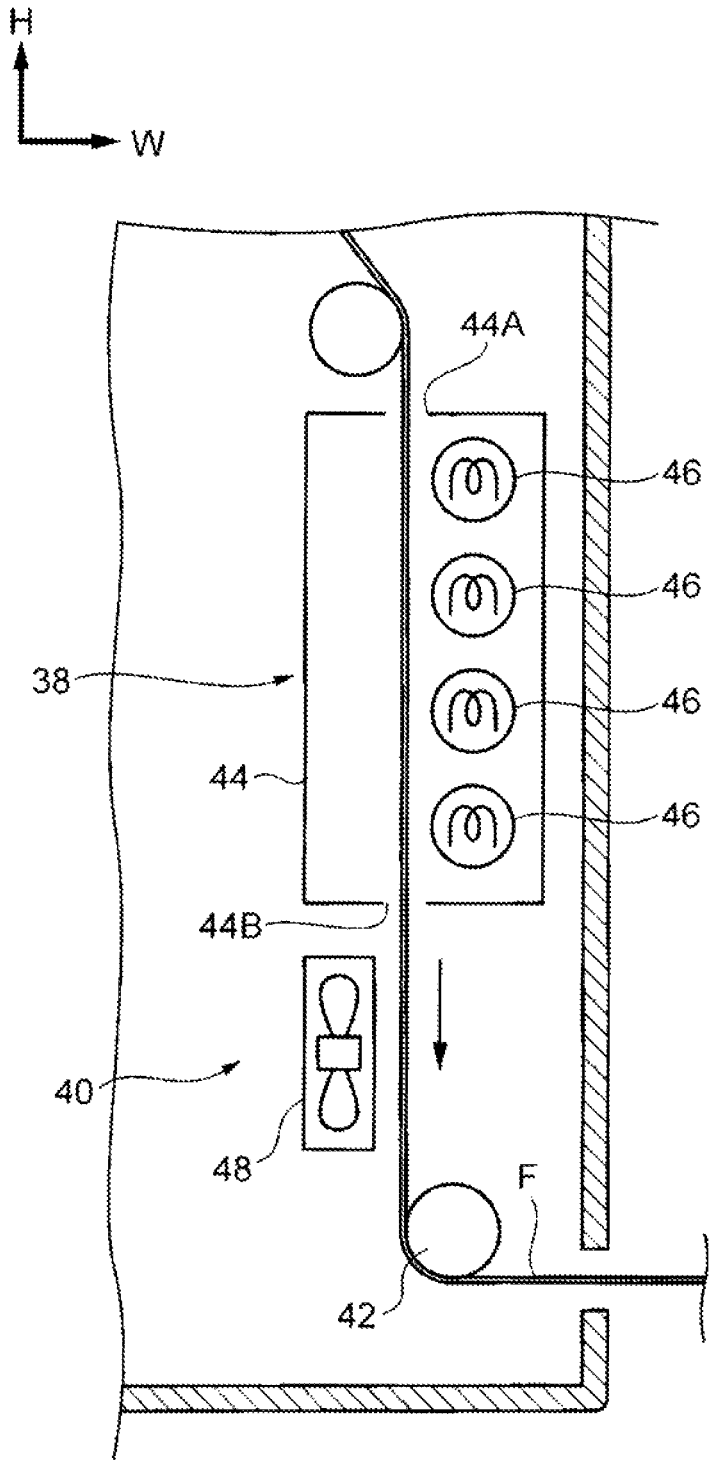
FIG. 3 is a configuration diagram illustrating the heating unit, the cooling unit, and the like included in the image forming device related to the embodiment of the invention.

The heating unit 38, as illustrated in FIG. 3, is arranged at the portion in which the film F is transported from the upstream side to the downstream side, and includes a housing 44 in which an inlet 44A into which the film F enters and an outlet 44B through which the film F exits are formed.

Moreover, the heating unit 38 further includes plural infrared light heaters 46 arranged so as to face the rear surface of the transported film F.

In this configuration, the heating units 18 and 38 are configured to heat the image to a temperature higher than the glass transition point of the macromolecular particles included in the liquid droplets discharged from the recording heads 16 and 36, and to dry the image.

Meanwhile, the image that should be dried by the heating unit 38 is an image formed on the rear surface of the film F. However, in the case of heating the image formed on the rear surface of the film F, the heating unit 38 also heats the image formed on the surface of the film F.

(Cooling Unit)

The cooling unit 20, as illustrated in FIG. 1, in the paper transporting direction, is arranged at the downstream side with respect to the heating unit 18 and at the upstream side with respect to the transporting roller 22.

The cooling unit 20 includes, as illustrated in FIG. 2, a cooling roller 28 that cools the image formed on the film F. In addition, the cooling roller 28 is, for example, in the state of being cooled by using chill water, which is not illustrated, configured to slave-rotate while in contact with the rear surface of the transported film F.

The cooling unit 40, as illustrated in FIG. 1, in the paper transporting direction, is arranged at the downstream side with respect to the heating unit 38 and at the upstream side with respect to the transporting roller 42.

The cooling unit 40 includes, as illustrated in FIG. 3, a cooling fan 48 that cools the image formed on the film F by blasting air on the film F. In addition, the cooling fan 48 is arranged to face the surface of the transported film F in a non-contact state.

In this configuration, before the image on the surface comes into contact with the transporting roller 22, the cooling unit 20 is configured to cool the image at the surface to a temperature equal to or lower than the glass transition point of the macromolecular particles included in the liquid droplets discharged from the recording head 16. In the same manner, before the image on the rear surface comes into contact with the transporting roller 42, the cooling unit 40 is configured to cool the image at the rear surface to a temperature equal to or lower than the glass transition point of the macromolecular particles included in the liquid droplets discharged from the recording head 36.

Hereby, an image in the state of being heated by the heating units 18 and 38 and softened (the state in which a sticky feel is provided) is hardened.

Meanwhile, in the cooling unit 40, the image formed on the surface of the film F heated by the heating unit 38 and the image formed on the rear surface are cooled to a temperature equal to or lower than the glass transition point.

(Operation of Main Configuration)

Next, the operation of the main configuration will be described based on the evaluation using the image forming device related to the comparative embodiment and the image forming device related to this embodiment.

(Evaluation Specification)

As the image forming device related to the comparative embodiment, "1400 Inkjet Color Continuous Feed Printing System" produced by Fuji Xerox was used.

As the image forming device related to this embodiment, a device in which "1400 inkjet Color Continuous Feed Printing System" produced by Fuji Xerox was added with cooling units 20 and 40 was used.

(Evaluation Condition)

1. In the evaluation, each of the inks of which the glass transition point of the macromolecular particles was 35 [° C.], and an ink of which the glass transition point of the macromolecular particles was 45 [° C.] was used.

2. The transporting speed of the film F was set to 50 [m/min] and 100 [m/min].

3. On the film F, a black solid image was formed.

4. In the heating units 18 and 38, the image formed on the film F was heated at 60 [° C.], which is higher than the glass transition point.

5. As for the ink, the ink with the following configuration was used.

Carbon black (Mogul L: produced by Cabot): 5 mass %

Styrene-acrylic acid copolymer sodium neutralizer (Mw=30000): 2.5 mass %

Acrylic emulsion (W-4627: produced by TOYOCHEM, particle diameter of 120 nm): 2 mass % (solid content)

Glycerin: 10 mass %

Diethylene glycol: 10 mass %

The following surfactants (produced by Nissin Chemical Industry) were independently used or mixed and the added amount thereof was changed to produce an ink with a desired surface tension. For the remaining portions, deionized water was used.

Olefin E1010, EXP. 4001, EXP. 4123, EXP. 4300: ethylene oxide adduct of acetylene diol Silface SAG002, SAG503A: polyether-modified silicone Meanwhile, the glass transition point was changed to 35 [° C.] and 45 [° C.] by changing the component ratio of the copolymerization of the acrylic emulsion.

(Evaluation Item and Measurement Item)

1. It was evaluated whether an image is adhered to the transporting roller 22 arranged at the downstream side of the paper transporting direction with respect to the heating unit 18 of the first image forming unit 12 that forms an image on the surface of the film F.

2. The temperature of the image when the image was in contact with the transporting roller 22 was measured.

(Evaluation Criteria and Result)

In the case where the image is adhered to the transporting roller 22, the result was marked by "X", and in the case where the image is not adhered to the transporting roller 22, the result was marked by "○". Meanwhile, as for whether the image is adhered, the evaluation was performed by visual observation.

In FIG. 4, the evaluation result and the measurement result are illustrated as a table. In the image forming device related to the comparative embodiment, the ink with the glass transition point of 45 [° C.] was used, and, in the case where the paper transporting speed is 50 [m/min], the temperature of the image was 40 [° C.], which is equal to or lower than the glass transition point. In this case, the evaluation result was "○". However, in the image forming device related to the comparative embodiment, in other cases, the temperature of the image was not equal to or lower than the glass transition point, and the evaluation result was "X".

Meanwhile, in the image forming device related to this embodiment, in all cases, the temperature of the image was equal to or lower than the glass transition point, and the evaluation result was "○".

(Consideration)

As described above, in the image forming device 10 related to this embodiment, by cooling the image to a temperature equal to or lower than the glass transition point in the cooling unit 20, the image in the state where the image is softened by being heated by the heating unit 18 (the state in which a sticky feel is provided) is hardened. As a result, adhering of the image to the transporting roller 22 is suppressed.

(Summary)

As described above, before the image heated by the heating unit 18 comes into contact with the transporting roller 22, the cooling unit 20 cools the image to a temperature equal to or lower than the glass transition point of the macromolecular particles. As a result, in a configuration in which the image formed by using liquid containing macromolecular particles comes into contact with the transporting roller 22 on the transporting route 58 after heating, compared to the case where the image comes into contact with the transporting roller 22 in the state where the temperature of the image is higher than the glass transition point, generation of an image defect on the image formed on the surface of the film F is suppressed.

In addition, before the image heated by the heating unit 38 comes into contact with the transporting roller 42, the cooling unit 40 cools the image to a temperature equal to or lower than the glass transition point of the macromolecular particles. As a result, in a configuration in which the image formed by using liquid containing macromolecular particles comes into contact with the transporting roller 42 on the transporting route 58 after heating, compared to the case where the image comes into contact with the transporting roller 42 in the state where the temperature of the image is higher than the glass transition point, generation of an image defect on the image formed on the rear surface of the film F is suppressed.

In addition, the cooling roller 28 included in the cooling unit 20 cools the image formed on the film F while in contact with the rear surface of the transported film F. Because of this, compared to the case where the image formed on the film F in a non-contact state with the film F is cooled, the image is effectively cooled.

Meanwhile, the invention is described in detail regarding a specific embodiment. However, the invention is not limited to the embodiment, and it is obvious to a person skilled in the art that it is possible to take other various embodiments in the scope of the invention. For example, in the embodiment above, a continuous film F (continuous-form paper) is used to describe the recording medium. However, a sheet of paper or the like (including a film base material or the like) may be used as the recording medium.

In addition, in the embodiment above, the film F is used to describe the recording medium. However, coated paper, plain paper, or the like may be used as the recording medium.

Moreover, even though there is no specific description in the embodiment above, in the case where the glass transition point is changed by the color of the ink, the heating unit may heat the image to a temperature higher than the highest glass transition point.

In addition, even though there is no special description in the embodiment above, in the case where the glass transition point is changed by the color of the ink, the cooling unit may cool the image to a temperature equal to or lower than the lowest glass transition point.

In addition, even though there is no special description in the embodiment above, before the image heated to a temperature higher than the glass transition point of the macromolecular particles by the heating units 18 and 38 comes into contact with the transporting rollers 22 and 42, the cooling units 20 and 40 cool the image to a temperature equal to or lower than the glass transition point of the macromolecular particles. However, the lower limit of the temperature of the cooled image can be equal to or higher than, for example, the room temperature (20 [° C.]).

Moreover, even though there is no special description in the embodiment above, the temperature of the image formed on the film F and the temperature of the film F of the portion on which the image is formed is the same.

Furthermore, in the embodiment above, as a member to which the image heated by the heating units 18 and 38 comes into contact with, the transporting rollers 22 and 42 are exemplified. However, a transporting guide or the like may be used.

In addition, in the embodiment above, the image forming device 10 includes the image forming unit 12 and the image forming unit 32. However, the image forming device 10 may only include the image forming unit 12.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming device comprising:

a transporting route on which a recording medium is transported;

an image forming unit that is provided on the transporting route and forms an image by discharging liquid droplets containing macromolecular particles on a front surface of the transported recording medium;

a heating unit that heats the image formed on the front surface of the recording medium to a temperature higher than a glass transition point of the macromolecular particles; and a cooling unit that, before the image heated by the heating unit comes into contact with a member on the transporting route, cools the image formed on the front surface of the recording medium to a temperature equal to or lower than the glass transition point of the macromolecular particles in a non-contact state with the image wherein the cooling unit is a cooling roller that is cooled by chill water and that cools the image by coming into contact with a rear surface of the recording medium, and slave-rotates while in contact with the rear surface of the recording medium, and the member of the transporting route is a transporting roller located on a downstream side of the cooling unit in the transporting route, the transporting roller coming into first contact with the front surface of the recording medium after the image formed on the front surface of the recording medium is cooled.

2. An image forming apparatus comprising:

the image forming device according to claim 1;

a rear surface image forming unit that is provided on the transporting route and forms an image by discharging the liquid droplets containing macromolecular particles on the rear surface of the recording medium on which the image is formed on the front surface by the image forming unit;

a rear surface heating unit that heats the images formed on the both surfaces of the recording medium to a temperature higher than the glass transition point of the macromolecular particles; and a rear surface cooling unit that, before the images heated by the rear surface heating unit comes into contact with a member on the transporting route, cools the images formed on the both surfaces of the recording medium to a temperature equal to or lower than the glass transition point of the macromolecular particles in a non-contact state with the recording medium.

3. The image forming device according to claim 1, wherein the member of the transporting route is a transporting roller located on a downstream side of the cooling unit in the transporting route, the transporting roller guiding the transporting route by contacting the front surface of the recording medium such that a transporting direction is changed.

4. The image forming device according to claim 1, wherein, in a case in which the glass transition point varies with respect to different colors of the liquid droplets, the heating unit heats the image to a temperature higher than a highest glass transition point of the macromolecular particles included in the liquid droplets and the cooling unit cools the image to a temperature equal to or lower than a lowest glass transition point of the macromolecular particles included in the liquid droplets.

* * * * *